US009088117B2

(12) United States Patent
Rosenblum

(10) Patent No.: US 9,088,117 B2
(45) **Date of Patent: *Jul. 21, 2015**

(54) POWER OUTLET EXTENSION SYSTEMS AND METHODS

(71) Applicant: Dean Rosenblum, Moorestown, NJ (US)

(72) Inventor: Dean Rosenblum, Moorestown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/295,268

(22) Filed: Jun. 3, 2014

(65) Prior Publication Data

US 2015/0155666 A1 Jun. 4, 2015

Related U.S. Application Data

(63) Continuation-in-part of application No. 13/688,721, filed on Nov. 29, 2012, now Pat. No. 8,740,627.

(51) Int. Cl.
*H01R 12/00* (2006.01)
*H01R 25/00* (2006.01)

(52) U.S. Cl.
CPC ..... *H01R 25/006* (2013.01)

(58) Field of Classification Search
CPC ..... H01R 9/096; H01R 13/72
USPC ..... 439/65, 640, 11, 31, 162, 501, 502, 439/531, 32
See application file for complete search history.

(56) References Cited

U.S. PATENT DOCUMENTS

| | | | | |
|---|---|---|---|---|
| 5,041,002 | A * | 8/1991 | Byrne | 439/215 |
| 6,653,532 | B1 * | 11/2003 | Raap et al. | 800/298 |
| 2014/0111158 | A1 * | 4/2014 | Kinomura et al. | 320/109 |

* cited by examiner

*Primary Examiner* — Phuongchi T Nguyen
(74) *Attorney, Agent, or Firm* — Buckley, Maschoff & Talwalkar LLC

(57) ABSTRACT

Pursuant to some embodiments, an electrical extension system including a telescoping extension having at least a lower section and an upper section and being manually extendable and contracted; a base to receive and support the telescoping extension, at least at two different locations on the base; a power strip mountable on a first end of the upper section, the power strip being mountable to the first end of the upper section at least at one terminal end of the power strip and a non-terminal end of the power strip; and a power cable, the power cable being in electrical communication with the power strip and extending into the telescoping extension.

18 Claims, 14 Drawing Sheets

POWER OUTLET EXTENSION SYSTEMS AND METHODS

BACKGROUND

As consumers have become increasingly dependent on electronic gadgets and gear, including mobile phones, laptops, tablets, e-readers, and the like, the need for accessible electrical power outlets has increased. Unfortunately, convenient and accessible power outlets are not always available where the consumer needs them, for example, at one's bedside, or near one's couch or reading chair.

And, while existing extension cords and power strips help address this need, they leave two key problems unsolved: convenience and tidiness. Specifically, plugging into extension cords or power strips often requires crawling on the floor to plug something in; and they also often look unsightly—a messy jumble of tangled wires.

As such, it would be desirable to provide power outlet extension systems and methods that solve these and other problems. Other advantages and features will become apparent upon reading the following disclosure.

DESCRIPTION

Embodiments of the present invention relate to power extension systems which provide convenient and attractive access to power outlets and/or other corded electronic connections. Pursuant to some embodiments, a power outlet extension comprises a base housing a drive motor, a telescoping extension mounted on the base, the telescoping extension having at least a lower section and an upper section, a power strip mounted on a first end of the upper section, the power strip in electrical communication with a power cable, the power cable extending through the telescoping extension and the base to a power outlet, the power cable further in electrical communication with the drive motor for selectively positioning the power strip by extending and retracting the upper section. In some embodiments, the lower section is formed as a part of the base.

Figure 1:
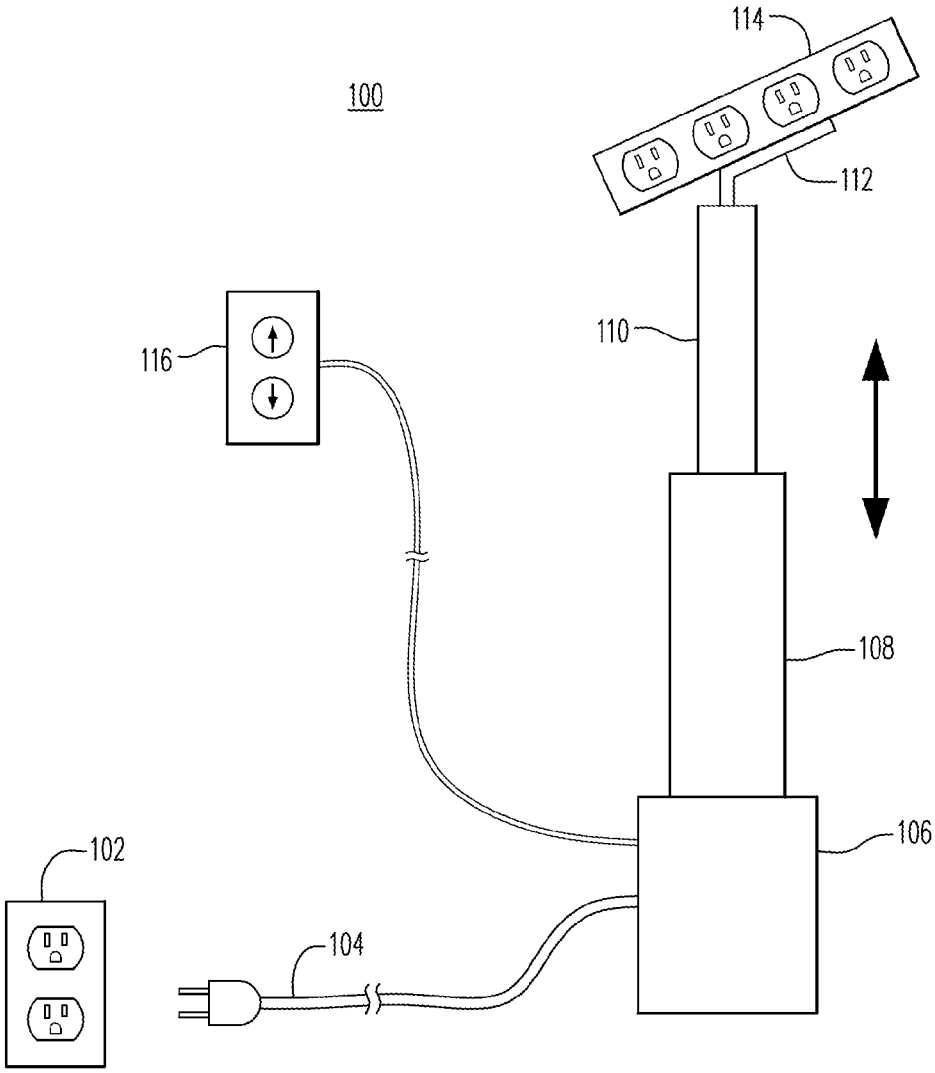
FIG. 1 is a block diagram depicting a system configured pursuant to some embodiments.

Reference is first made to FIG. 1, where a block diagram of a system pursuant to some embodiments is shown. As depicted in FIG. 1, the extension system 100 includes a number of components which together provide a convenient and attractive mechanism for providing power in areas where a wall outlet may be inaccessible or inconvenient. For example, the embodiment depicted in FIG. 1 allows access to a power source such as a wall outlet 102. The system 100 includes a power cord 104 for supplying power from the power source (such as wall outlet 102) to one or more power strip outlets 114 of the system. Pursuant to embodiments of the present invention, the power strip outlets 114 may be extended or moved into a variety of positions as desired by the user.

The plug of the power cord 104 may include a ground fault circuit interruption (GFCI) circuit. As will be appreciated by one skilled in the art, the electronic components of the system 100, including an optional circuit board with surge suppression (not shown), are standard in the industry and therefore will not be discussed herein. The power cord 104 extends from a base 106 and may be retractable into the base 106 or may be a fixed length.

The base 106 supports one or more extension sections which extend and retract to position the height of the power strip 114 as desired by a user. In the embodiment depicted in FIG. 1, two extension sections are provided—a first, lower section 108, and a second, upper section 110. In the embodiment of FIG. 1, the lower section 108 is fixed or stationary, and does not extend or retract vertically. The lower section 108 is mounted on a top portion of the base 106 and is formed to receive the upper section 110 when the upper section 110 is retracted or lowered. In some embodiments, the lower extension section 108 is part of, and integral to the base 106. In some embodiments, the base 106 is formed to provide one or more electrical outlets (not shown) which are in addition to those included in the power strip 114. As will be discussed further herein, the upper section 110 may be movable under control of a gear or drive system, which may be disposed within the lower section 108 or within the base 106. The upper section 110 may be extended or retracted to position the power strip 114 at various heights, allowing the power strip 114 to be conveniently placed for ready access by a user. For example, the system 100 may be positioned behind a piece of furniture, such as a night stand, a desk, a chair, a sofa, or the like, and extended to a position allowing ready access to the power strip 114.

The power strip 114 may be movably mounted on a top portion of the upper section 110 via a mounting hinge 112. Mounting hinge 112 may be an L-shaped hinge that allows the power strip 114 to be positioned at different angles, allowing improved access to the receptacles thereon. Further, the position of the power strip 114 may be rotatable around the center axis of the upper section 110, allowing further adjustment and access to the receptacles of the power strip 114. A power cord (not shown in FIG. 1) may extend through a center of the upper section 110, the lower section 108 and the base 106 providing an electrical connection between the power strip 114 and the power supply 102.

Pursuant to some embodiments, the extension or retraction of the upper section 110 may be controlled by an activation switch 116 which controls a motor or drive system (not shown in FIG. 1). The activation switch 116 may be in communication with the motor or drive system via a wired or wireless connection. The result is an improved power outlet system that allows power outlets to be positioned in a convenient and attractive fashion in a wide variety of positions and locations, and conveniently stored out of site when not in use, all at a user's discretion and control.

Figure 2:
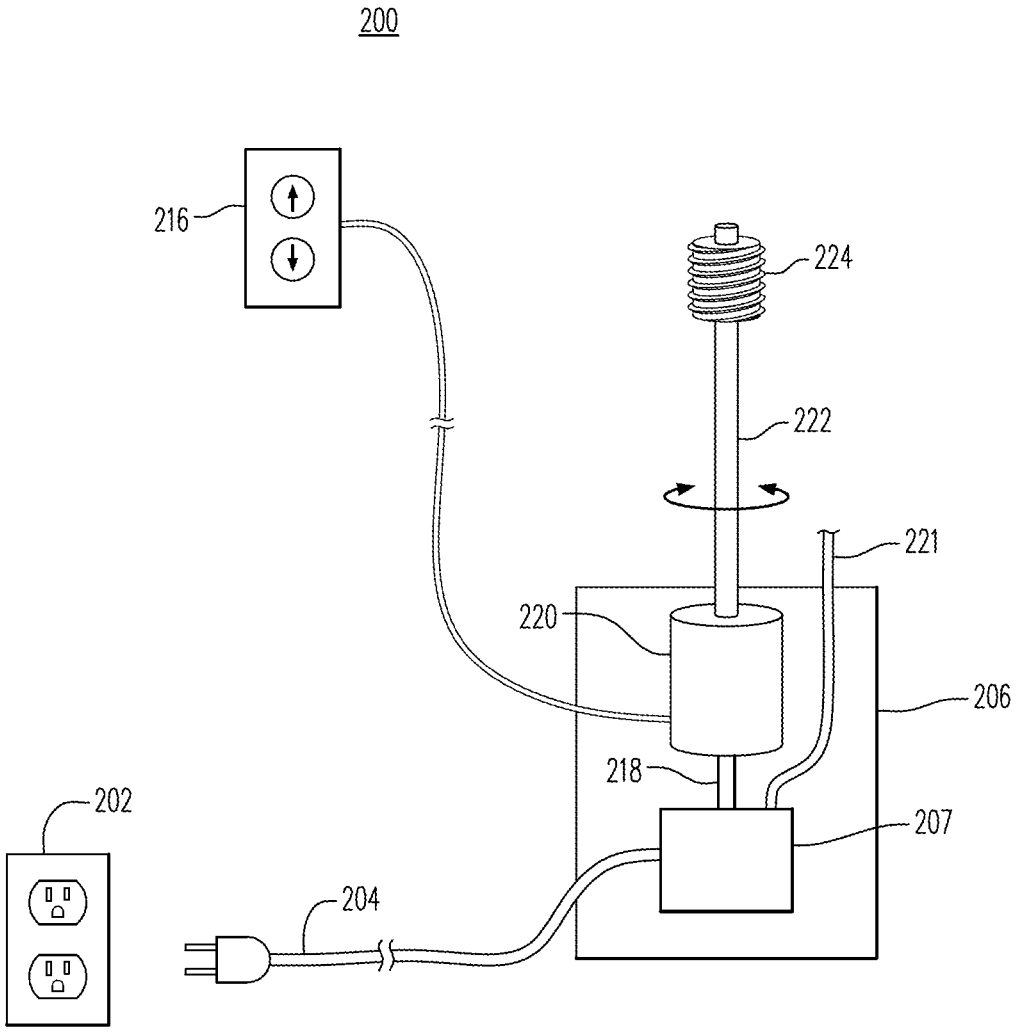
FIG. 2 is a further block diagram of a system configured pursuant to some embodiments.

Reference is now made to FIG. 2 where a cross-sectional view of an embodiment of a system pursuant to some embodiments is shown. In particular, FIG. 2 depicts a portion of a system 200, including a cross-sectional view of components disposed within a base 206 of a system 200 (the exterior of which may appear as that shown in FIG. 1). Similar to the view shown in FIG. 1, the system of FIG. 2 obtains power from a power supply or outlet 202 via a power cord 204. The power cord 204 is shown as extending into the base 206 (e.g., via an aperture, not shown). The power cord 204 is coupled to a divider or step down amplifier 207 which allows power to be provided to a reversible electric motor 220 (via a connector 218). The divider 207 also passes power via 2213 to the power strip (not shown in FIG. 2).

The reversible electric motor 220 provides rotational drive to a gear shaft 222 that extends upwardly from the base 206 to a worm gear 224. The worm gear 224 has a number of threads that mate with corresponding slots—effectively a rack gear—disposed within an inner surface of the upper section, (not shown in FIG. 2, shown as item 110 in FIG. 1). As the electric motor 220 turns the gear shaft 222, the worm gear 224 drives the upper section 110 along an axis of the gear shaft 222. Rotation of the upper section 110 may be prevented through use of a track provided on an inner surface of the lower section 108 (not shown). Operation of the reversible electric motor 220 may be controlled by an activation switch 216 in communication with the reversible electric motor 220 via a wireless or wired connection. Those skilled in the art, upon reading this disclosure, will appreciate that a number of different extension mechanisms, including drives and/or motors, may be utilized to provide the longitudinal drive of the upper section 110.

Figure 3:
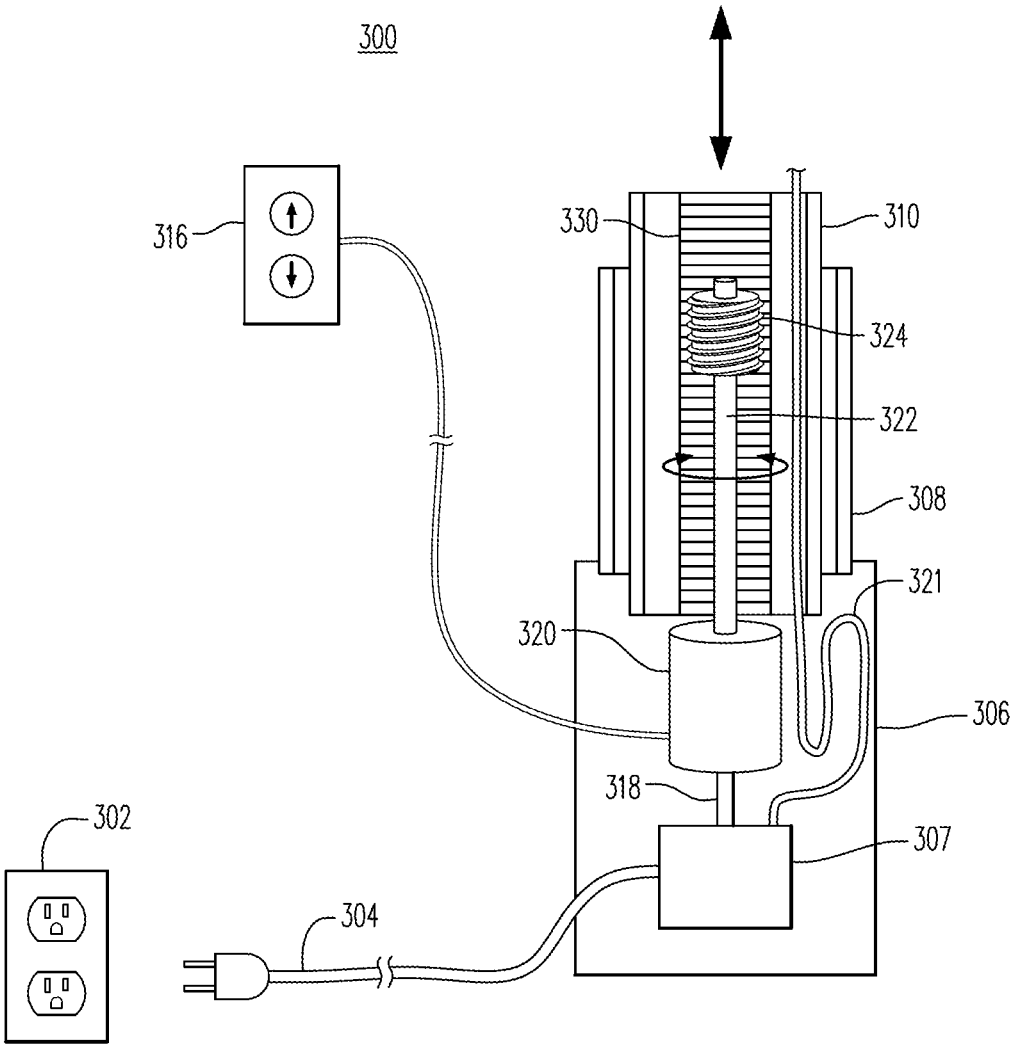
FIG. 3 is a block diagram depicting a portion of a system of FIG. 1 pursuant to some embodiments.

Further details of some embodiments will now be described by reference to FIG. 3, which is a partial side view of the system of FIG. 1. More particularly, the system 300 of FIG. 3 shows a cross sectional view of certain components of the system of FIG. 1 including the base 306, the lower section 308 and the upper section 310. As shown, the base 306 houses components including a divider 307 and a reversible electric motor 320 which drives a rotating gear shaft 322. The shaft 322 has a worm gear 324 positioned to mate with a rack gear 330 mounted on (or formed in) an inner surface of the upper section 310. The worm gear 324 and rack gear 330 mate such that when the worm gear 324 rotates, the rack gear 330 moves longitudinally along the axis of the gear shaft 322 thereby causing the upper section to extend or retract.

The use of a worm gear as shown in FIG. 3 is one example of a drive mechanism that may be used in conjunction with embodiments of the present invention. Such a gear provides a number of benefits, including the ability to deploy a drive mechanism in a narrow cross-sectional profile, allowing the use of a relatively slim upper section 310 and lower section 308. Further, such a drive mechanism provides favorable gearing leverage, where the effort distance of the worm gear 324 (as compared to the resistance distance of the rack gear 330) provides a significant mechanical advantage. By using such a drive mechanism, a smaller, less powerful extension motor 320 may be used, and which can be selected to provide a longer life and lower maintenance.

Referring still to FIG. 3, a brief overview of the operation of the system will now be provided. Once power is supplied to the system (e.g., via power source 302) and the system is positioned in a desired location (e.g., behind a piece of furniture or the like), a user interacts with switch 316. The switch 316 may have directional controls, such as a first button or switch to cause extension of the system, and a second button or switch to cause the system to retract. By interacting with the switch 316, the motor 320 is activated (in a direction corresponding to the directional control) and causes shaft 322 to rotate. Rotation of the shaft 322 causes the worm gear 324 to rotate. Rotation of the worm gear 324 causes the rack gear 330 to extend or retract longitudinally based on the direction of rotation. The upper section 310 extends (or retracts) longitudinally along with the rack gear 330. The lower section 308 remains fixed and does not rotate. When the switch 316 is released, the motor 320 stops, which stops rotation of the shaft 322 as well as the worm gear 324. The upper section 310 locks into position, allowing ready access to the power strip (not shown in FIG. 3, shown as item 114 of FIG. 1) at the extended position desired by the user. The user may then adjust the orientation of the power strip 114 as desired.

While the system has been described as being a separate unit, positionable behind or proximate to a piece of furniture or in other positions as desired, in some embodiments, the system may be built into furniture or other items. For example, referring now to FIG. 4, a built in embodiment of the present invention is shown. For illustrative purposes, the system is shown as built in to a desk, however, those skilled in the art, upon reading this disclosure, will appreciate that embodiments may be installed in or used in conjunction with other items. For example, embodiments may be installed in dressers, night stands, desks, tables, entertainment units, or the like.

Figure 4A:
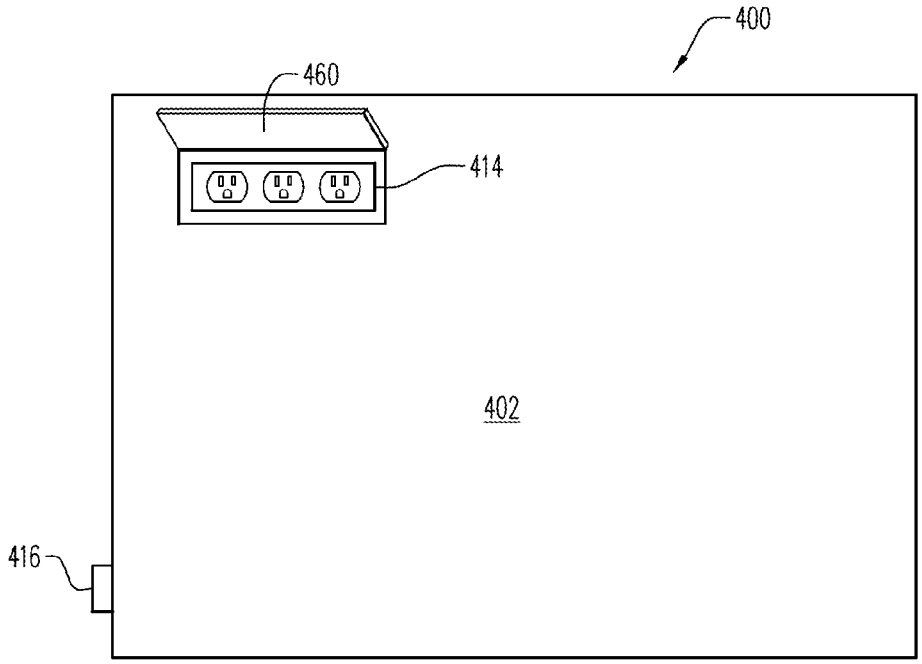
FIGS. 4A-4B are views of a further embodiment of a system pursuant to some embodiments.

Referring first to FIG. 4A, a top view of a desk or a table 400 in which a power supply system pursuant to the present invention has been installed. The desk 400 has a top 402 through which an aperture has been formed to allow access to a power strip 414 positioned atop an upper section (not shown in FIG. 4A) of a power system of the present invention. The power strip 414 may be slightly recessed within the aperture so that a cover 460 may lie flush with the desk top 402. The cover 460 may be a hinged cover, a retractable cover, or the like allowing ready access to the power strip 114 as needed.

Figure 4B:
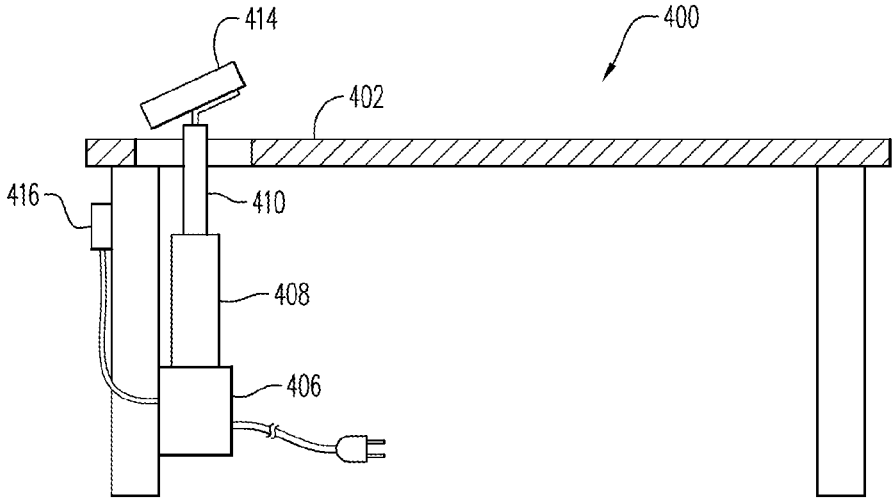

Referring now to FIG. 4B, a side view of a desk or table 400 is shown. As depicted, a power supply system pursuant to the present invention is mounted inside the desk or table 400 such that the components are out of the way, while still providing ready access to the power strip as well as the activation switch 416. The components may be mounted on an inner wall or leg of the desk or table 400 or may be configured to stand on a base of the system (e.g., as shown in FIG. 1). The components may be positioned beneath an aperture in the top 402 of the desk 400 such that when the upper section 410 is extended, it extends the power strip 414 through the aperture for ready access by a user. When the upper section 410 is retracted, it may retract through the aperture so that a cover 460 may be closed over the aperture. The activation switch 416 may be positioned on an outer wall of a side of the desk 400 or in another convenient location. The result is a power supply system that is easily positionable allowing convenient and ready access to a power strip.

Figure 5A:
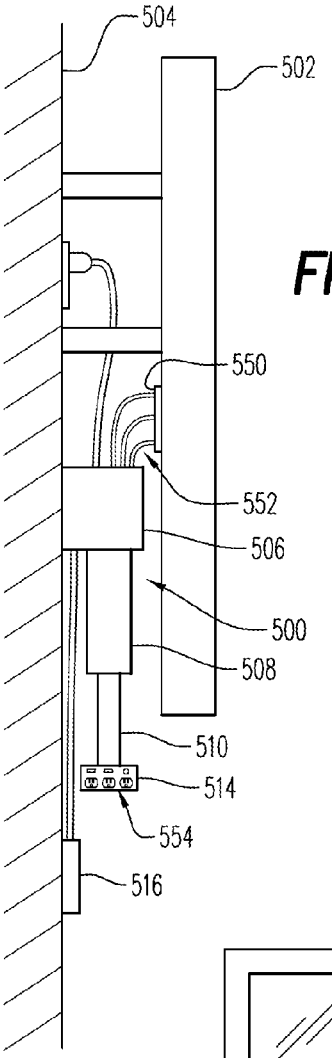
FIGS. 5A-5B are views of a further embodiment of a system pursuant to some embodiments.

Referring now to FIG. 5, a further embodiment of the present invention is shown for use in providing access to device input/output ports for devices such as televisions, stereos, computers or the like, where such ports are inconveniently located on said device. FIG. 5A is a side view of a system 500 for providing access to a television's input/output ports 502 when said TV is installed on a surface 504 such as a wall. It is common to mount devices, such as flat panel televisions, on surfaces for improved viewing. Unfortunately, while such positioning allows improved viewing and aesthetics, it often results in difficult access to power and data or input ports to the television. For example, many televisions currently have a plurality of device input ports 550 located on a back side of the television. If the television is to be connected to other devices (such as video recorders, cable sources, gaming systems, electronic tablets, or the like), it can be difficult to access the device input ports 550 after the television has been mounted on the wall. Embodiments provide an improved system for access to the device input ports 550 as well as for providing access to power for use with other devices.

Figure 5B:
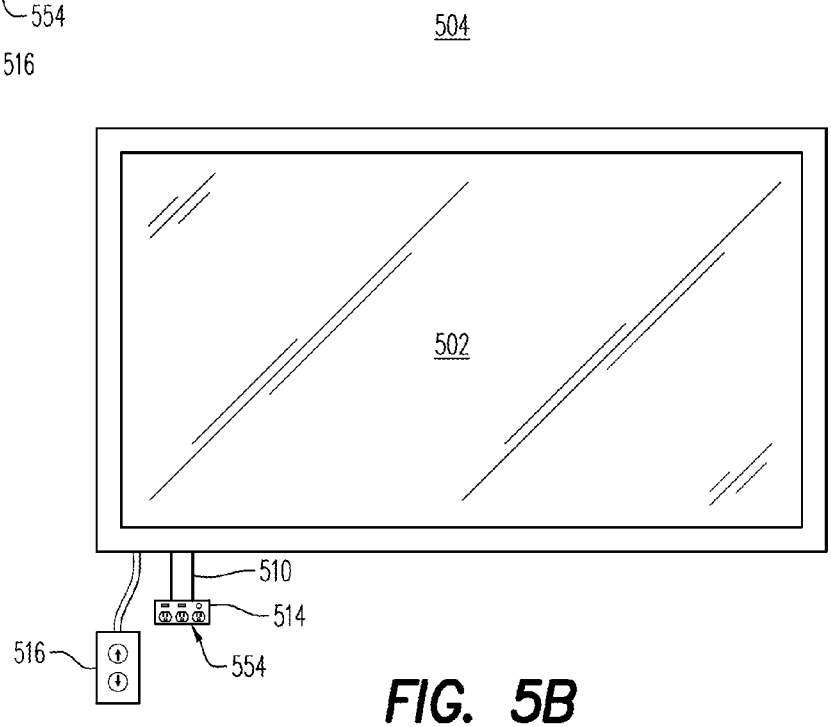

As shown in system 500, an extendable strip 514 is provided which is mounted on a device similar to that shown in FIG. 1 (where a base 506 is mounted on the wall 504). System 500 further includes a lower section 508 and an upper section 510. The extendable strip 514 includes a number of ports 554 corresponding to device input ports 550 commonly found on a television or other electronic unit. For example, the extendable strip 514 may include normal power outlets (for use in providing power to one or more electronic items) as well as ports for video, audio, data, or the like. Ports 554 are connected to device input ports 550 via a plurality of bridge wires 552 which extend to a base 506 and through a body to the extendable strip 514. As shown, the position of the extendable strip 514 may be controlled using an activation switch 516. In this manner, the extendable strip 514 may be extended from behind the television for access to the device input ports on the strip 514, and then retracted after use. A front view of such an embodiment is shown in FIG. 5B, where the television 502 is shown with the extendable strip 514 extended from behind the television 502 for access.

It will be understood that the foregoing description is of exemplary embodiments of the present invention and that the invention is not limited to the specific forms shown or described. For example, while the embodiment depicted in FIG. 1 includes a power strip with six outlets or receptacles; the strip may include more or fewer receptacles. Further, while the receptacles are shown in a single row, multiple rows may be provided. In the embodiment depicted in FIG. 1, two sections are described (one fixed, and one movable). In some embodiments, a different number of sections may be provided (for example, two or more upper movable sections may be provided which telescope to extend the power strip). In some embodiments, one or more power adapters may be built in or attached to the power strip. For example, a power adapter and cord for an Apple iPhone® or other portable device may be formed or provided as a part of the power strip.

Further, although the strip is shown as being substantially rectangular in shape, the strip may be formed in other shapes (such as a pentagonal, hexagonal, square, or other shape). The base, and other sections, may be formed in other shapes as well. For example, the base or other sections may be cylindrical, rectangular, or the like. Further, while a corded electric motor is described herein, a battery powered motor may also be used with desirable results. Further still, while a worm and rack gear combination is described, those skilled in the art will appreciate that other drive mechanisms may also be used. Other embodiments of the strip may include USB-format charging ports, or even retractable charging cables for common devices, such as iPads/iPhones, Blackberries and the like. Further, this present invention may be included as part of, or may itself include a battery back-up system, to provide continuity of power supply to connected devices in the event of an electrical power outage.

In some embodiments, a system herein may connect to, interface with, or integrate with an electrical (i.e., power and/or other signals) system of a vehicle. The vehicle may be a car, a boat, an airplane, a train, a personal transport device, and any other transportation devices or systems. The system may connect to or be integrated into an interior or an exterior of the vehicle. In some regards, the system may provide electrical power for one or more specific voltage(s) and current(s) generated by, for example, the vehicle's on-board electrical systems (e.g., 110 v, 12 v, 5 v, alternating current (AC), direct current (DC), and combinations thereof). In some aspects, the system may include an electrical receptacle to receive one or more specific configurations of electrical plugs and attachments, including but not limited to a 110 v plug, whether grounded or not; a car accessory plug; USB (universal serial bus) plug; etc. In some regards, the system may provide an extension of electrical signals for one or more specific communication signal(s) generated or transmitted by the vehicle, or transmitted to the vehicle's on-board components or systems from an attached external device, including, for example, audio, video, communication (e.g., mobile telephony), data, internet, messaging, and other signals.

In addition to the exemplary embodiments described hereinabove, some embodiments of the present disclosure may include an electrical extension system. While the embodiment depicted in FIG. 1 includes a power strip with a plurality of power outlets or receptacles that are in electrical communication with a power cable, the strip of an electrical extension system herein may include one or more electrical outlets or receptacles which are in electrical communication with an electrical cable, where the electrical outlets may interface or connect to any type of electrical signal and the electrical cable is suitable for carrying the electrical signal. In some aspects, the electrical signal can include one or more specific signal(s) including, for example, audio, video, communication (e.g., telephony), data, internet, messaging, and other signals. In some embodiments the electrical extension system herein may include, alone or in combination, for example, a power cable, power outlet(s), and a drive motor for extending and extracting a telescoping extension, and other aspects, in accordance with some aspects of the present disclosure.

Embodiments of the present invention relate to power extension systems which provide convenient and attractive access to power outlets and/or other corded electronic signal connections. Pursuant to some embodiments, a power outlet extension comprises a telescoping extension having at least a lower section and an upper section and being manually extendable and contracted; a base to receive and support the telescoping extension; a power strip mountable on a first end of the upper section, where the power strip is mountable to the first end of the upper section at least at one terminal end of the power strip and a non-terminal end of the power strip; and a power cable that is in electrical communication with the power strip and extending into the telescoping extension. In some embodiments, the base may receive and support the telescoping extension at least at two different locations on the base.

Figure 6:
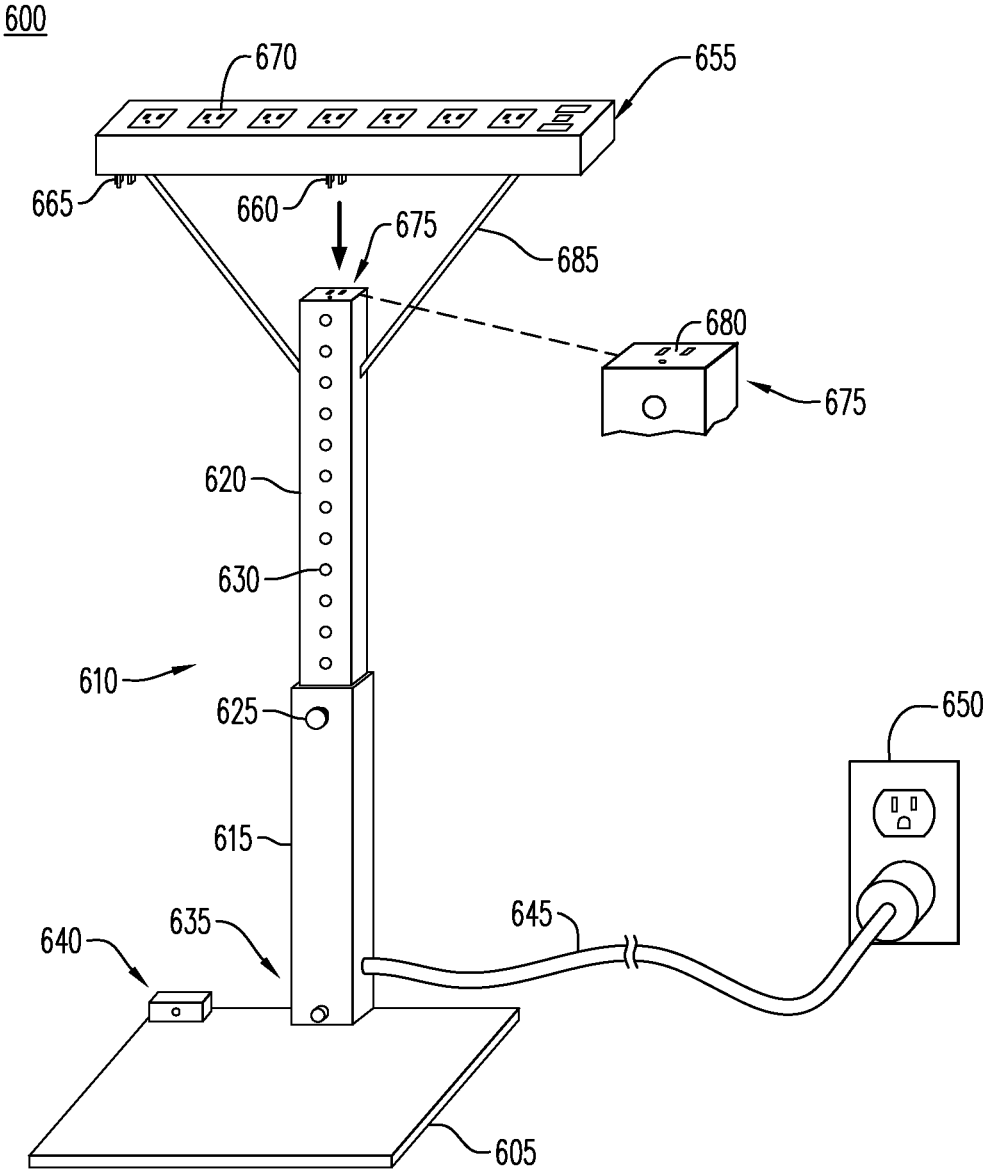
FIG. 6 is an illustrative depiction of a system configured pursuant to some embodiments.

Reference is first made to FIG. 6, where a diagram of a system 600 pursuant to some embodiments is shown. As depicted in FIG. 6, a base 605 is shown supporting an extension system 610. The extension system in FIG. 6 is a telescoping extension system that includes a lower section 615 and an upper section 620. The lower section and the upper section operatively cooperate to be manually extendable.

Likewise, the components of extension system 610 may be manually manipulated to a contracted configuration. In some aspects, a locking pin or other device may interact with keyhole(s) 630 and other features to provide a mechanism for positioning the extension system 600 at various discrete lengths or states of expansion/contraction. Other methods, features, and systems for selectively adjusting the extent of extension for extension system 600 may be used in system 600.

In some aspects, base 605 includes at least two different locations 635 and 640 for receiving and supporting extension system 610. At location 635, the extension system will be located substantially at a midpoint of an edge of the base, along a peripheral boundary thereof. At location 640, the extension system will be located substantially at a corner location of the base. Locations 635 and 640 may each include an aperture or other mating surface or feature to receive lower portion 615 of the extension system. In some embodiments, the upper portion 620 may be moveable relative to a stationary base 615.

System 600 further includes a power strip 655 that is mountable on a first end of upper section 620. The power strip includes a feature 660 (e.g., a plug) for electrically interfacing with the upper portion of the extension system. The feature for electrically interfacing with the upper portion of the extension system may be any known electrical connector system, including but not limited to household, industrial, and commercial environment connectors and interfaces and those that become known in the future. A detailed view of the first end of upper portion 620 is shown at 675. As illustrated, there is a socket 680 for receiving the power strip's feature 660. Other electrical connectors may be used in place of or in combination with features 660 and 680. Connectors such as, for example, the plug and socket system shown in FIG. 6 are included in some embodiments to complete an electrical pathway from outlet 650 to power cord 645 that extends into extension system 600 to electrical connector 660 to at least one of the electrical outlets 670 disposed in power strip 655. In some embodiments, other components or features (not shown) may be included internally in one or more of the base, the extension system, and the power strip to facilitate and contribute to a conductive pathway from the power cord to the power strip. Examples of such features and components may include electrical wires, conductive traces, and other electrical conduction mechanisms. In some embodiments, one or more of the outlets in power strip 655 may be configured for signals (e.g., voice communication, data signals, etc.) other than electricity.

In some embodiments, power strip 655 may be selectively removable from the first end of the upper section 620. This removability may facilitate connecting power strip 655 to the first end of upper section 620 via an electrical connector (e.g., a plug) located at a terminal end of the power strip. In some embodiments, the location of electrical connectors 660 and 680 may be reversed, without loss of generality.

In some aspects, system 600 may be configured with the power strip connected to the upper section 620 via an end or terminal location 665 or a center location 660. Accordingly, system 600 may be manually configured by a user to conform or fit in a variety of locations given the flexibility provided by the adjustable and reconfigurable base and extension system interface, the expandable and collapsible extension system 610, and the reconfigurable power strip attachment point (e.g., locations 665 and 660).

In some embodiments, system 600 may include one or more support arms or brackets 685. In some aspects, bracket 685 may be repositionable depending, in some instances, on the mounting location of power strip 655 used to interface with upper section 620.

Figure 7:
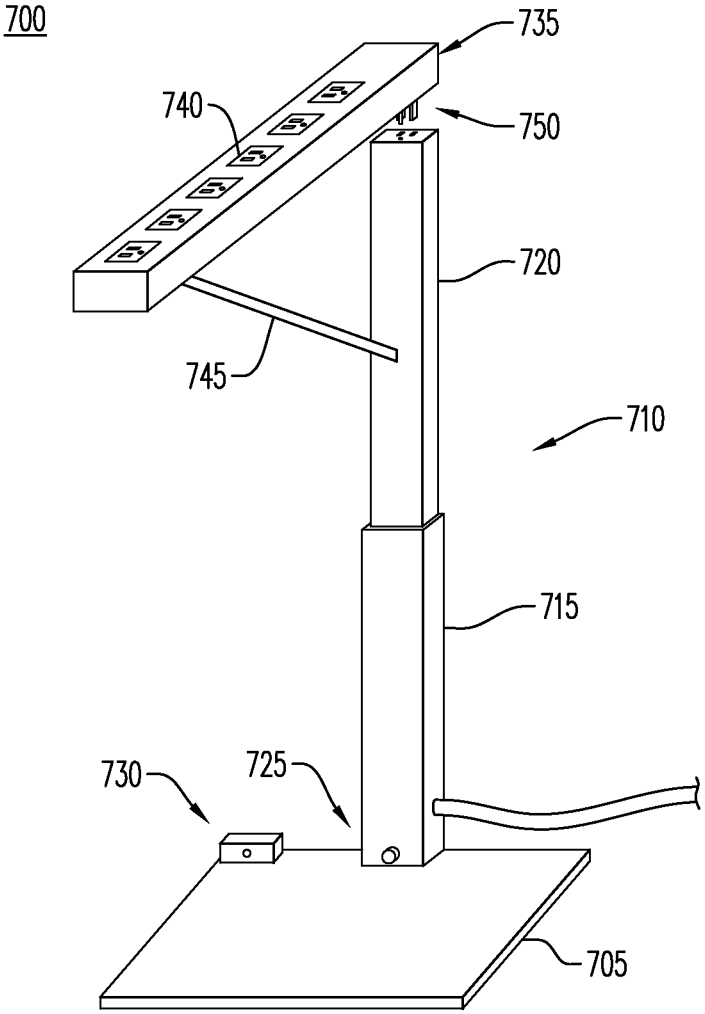
FIG. 7 is a further illustrative depiction of a system configured pursuant to some embodiments.

FIG. 7 is an illustrative depiction of a system 700, in accordance with some embodiments herein. System 700 includes a base 705, an extension system 710 comprising a lower section 715 and an upper section 720, a central location 725 for removably receiving and anchoring the extension system to the base and a second (corner) location 730 for removably receiving and anchoring the extension system to base 705. System 700 further includes a power strip 735 having one or more electrical and other outlets or ports for different types of signals (e.g., audio, data network signals, video, etc.).

In some regards, system 700 may be similar to system 600. Accordingly, an understating of system 700 may be had by referring to the description of system 600. In a departure from FIG. 6, the system of FIG. 7 shows power strip 735 being connected or mounted to upper section 720 at an end or terminal location of the power strip, the end location including a device 750 (e.g., a plug) for mechanically and electrically interfacing with upper section 720. In some aspects, support arm or bracket 745 may provide a measure of support and stability to the power strip configured as shown in FIG. 7.

Figure 8:
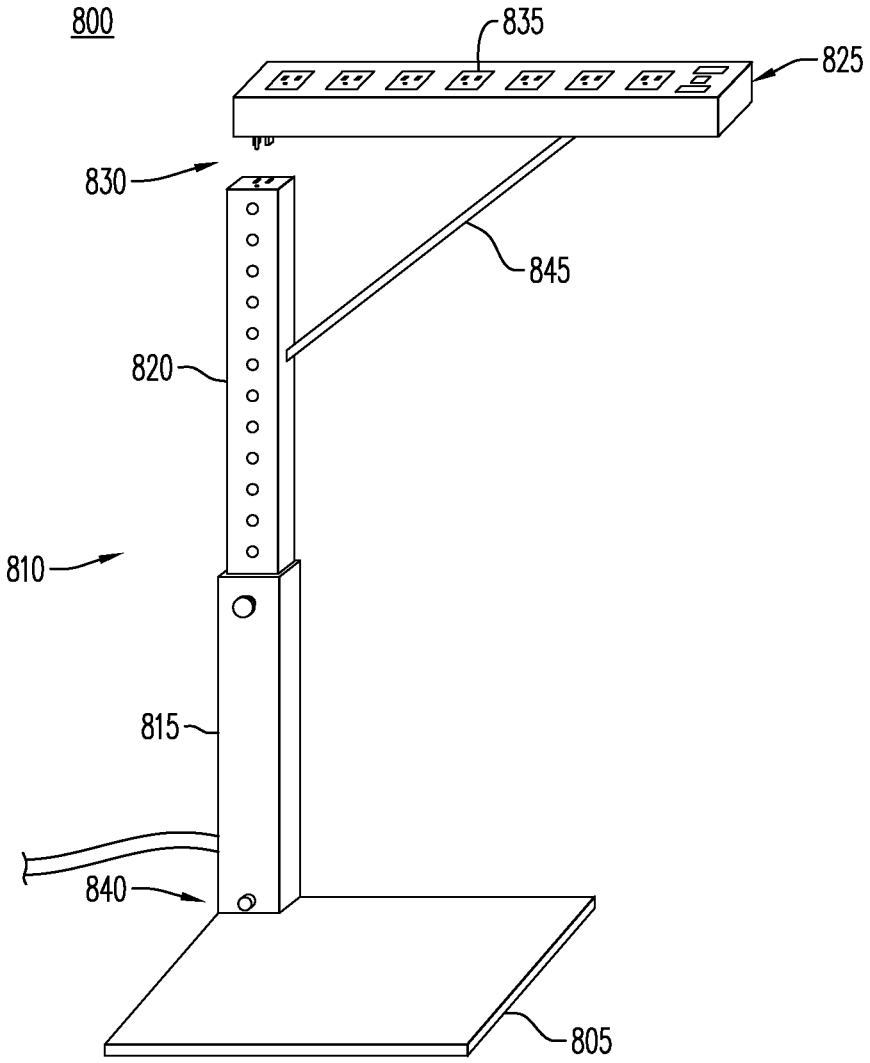
FIG. 8 is an illustrative depiction of a system, according to some embodiments herein.

FIG. 8 is an illustrative depiction of a system 800, in accordance with some embodiments herein. System 800 includes a base 805, an extension system 810 comprising a lower section 815 and an upper section 820, a corner location 840 for removably receiving and anchoring the extension system to the base. System 800 further includes a power strip 825 having one or more electrical and other outlets or ports 835 for different types of signals.

In some regards, system 800 may be similar to system 600. As such, an understating of system 800 may be had by referring to the description of system 600. In contrast to FIG. 6, the system of FIG. 8 shows power strip 825 being connected or mounted to upper section 820 at an end or terminal location of the power strip, the end location including a device 830 (e.g., a plug) for mechanically and electrically interfacing with upper section 820. Furthermore, extension system 810 is shown mounted on or received by base 805 at corner location 840. In some aspects, support arm or bracket 845 may provide a measure of support and stability to the power strip configured as shown in FIG. 8.

Figure 9:
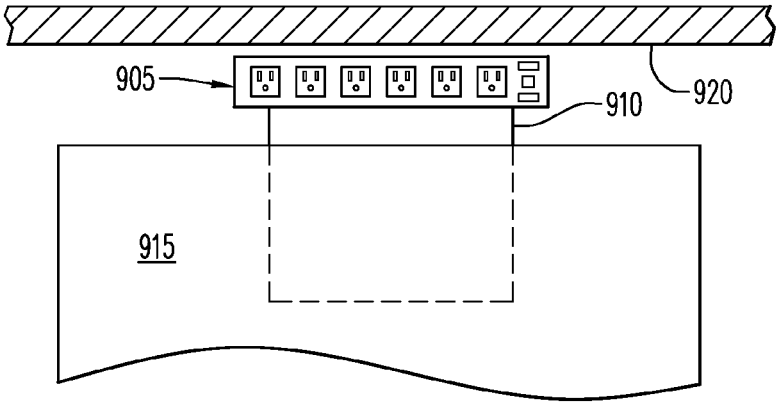
FIG. 9 is a depiction of a system according to some embodiments in an illustrative environment.

FIG. 9 is a top-down depiction of a power outlet extension system comprising base 910 and power strip 905, in close proximity to a wall 920 and a table or other structural object 915. The power outlet extension system depicted in FIG. 9 may correspond, in part, to the system of FIG. 6 where the power strip is centrally mounted on the upper section of the extension system and the extension system is mounted in a center edge position of the base. Accordingly, it is seen that the power strip 905 is centrally located relative to base 910.

Figure 10:
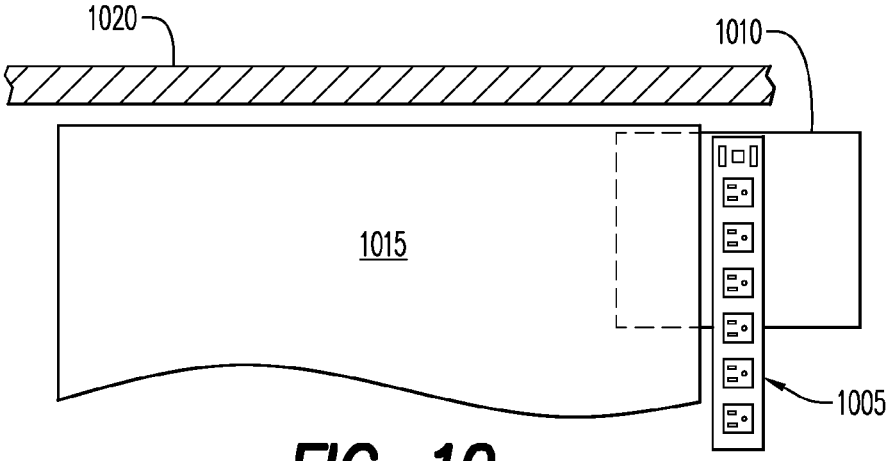
FIG. 10 is a depiction of a system according to some embodiments in another illustrative environment.

FIG. 10 is a top-down depiction of a power outlet extension system comprising base 1010 and power strip 1005, in close proximity to a wall 1020 and a table or other structural object 1015. The power outlet extension system depicted in FIG. 10 may be configured, in part, similar to the system of FIG. 7 where the power strip is mounted on the upper section of the extension system at a terminal end location and the extension system is mounted in a center edge position of the base. Accordingly, it is seen that power strip 1005 may be positioned close to an edge of the structural object 1015.

Figure 11:
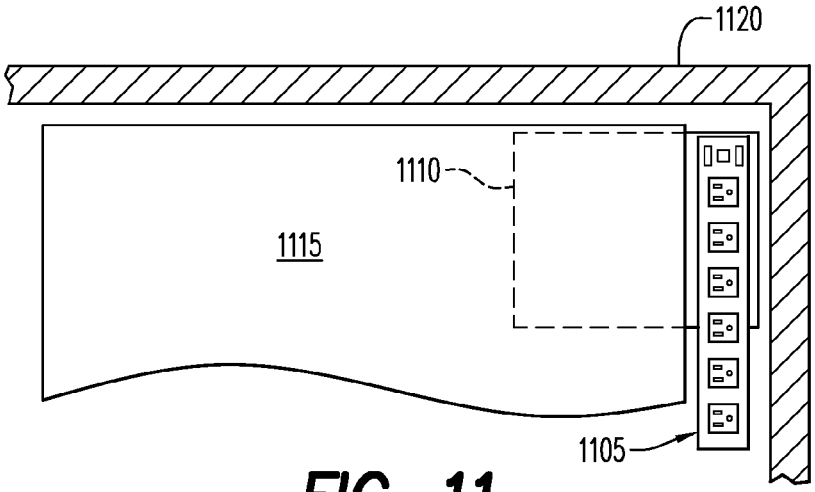
FIG. 11 is a depiction of a system according to some embodiments in an illustrative environment.

FIG. 11 is a top-down depiction of a power outlet extension system comprising base 1110 and power strip 1105, in close proximity to a corner of wall 1120 and a table or other structural object 1115. The power outlet extension system depicted in FIG. 11 may be configured, in part, similar to the system of FIG. 8, where the power strip is mounted on the upper section of the extension system at a terminal end location and the extension system is mounted to the base at a corner location or position of the base. Accordingly, it is seen that power strip 1105 may be positioned close to an edge of the structural object 1115, even in a corner.

Figure 12:
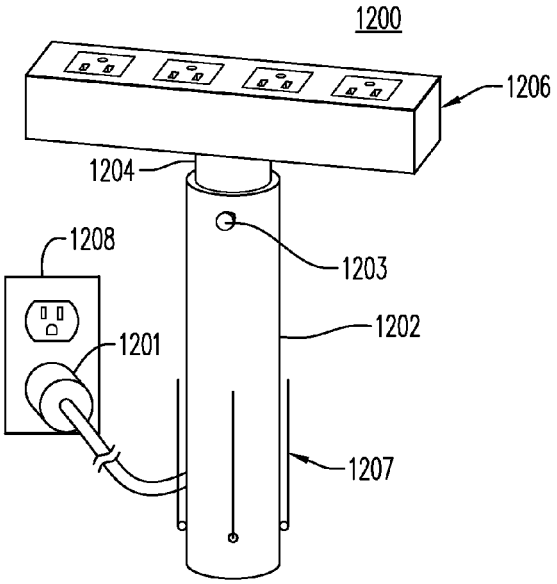
FIGS. 12 and 13 are illustrative depictions of a system, according to some embodiments.
Figure 13:
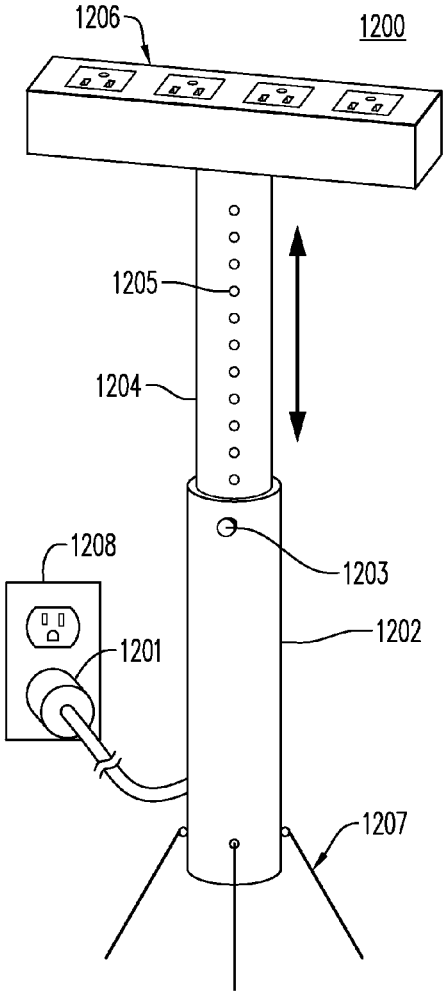

FIGS. 12 and 13 illustrate some aspects of some embodiments herein. FIGS. 12 and 13 relate to an electrical extension system 1200 including an extension mechanism including a stationary base 1202 and a manually moveable extension section 1204. The system further includes a power strip 1206 that may include ports for signals other than electricity. Power strip 1206, including at least one of the outlets or ports thereon, is electrically connected to power cord 1201 that may connect to outlet 1208. Base 1202 may be further stabilized by positioning or deploying "legs" or "feet" in the configuration shown in FIG. 13. In some instances, the legs 1207 need not be deployed and may be stowed in the position shown in FIG. 12, whether for storage reasons, conservation of space used by system 1200, and other considerations.

FIGS. 12 and 13 illustrate the extension of a manually extendable extension system of some embodiments herein. In particular, FIG. 12 shows the extension system comprising base section 1207 and the manually movable/adjustable extension section 1204. The extension system may be manually adjusted (e.g., extended and contracted) by a user. A relative position of the base section 1202 and the manually movable/adjustable extension section 1204 may be set to and held at a predetermined relative position by, for example, locking "button" or spring-loaded pin 1203 and receptacles or "key-holes" 1205. It is noted that other locking and selective positioning mechanisms may be used in some embodiments. FIG. 12 shows the manually adjustable extension system of system 1200 in a fully retracted state and FIG. 13 shows the system with the extension system in a fully extended stated. System 1200 may be configured at any one of the predetermined, user-selectable positions between the fully retracted state and the fully extended state.

Figure 14:
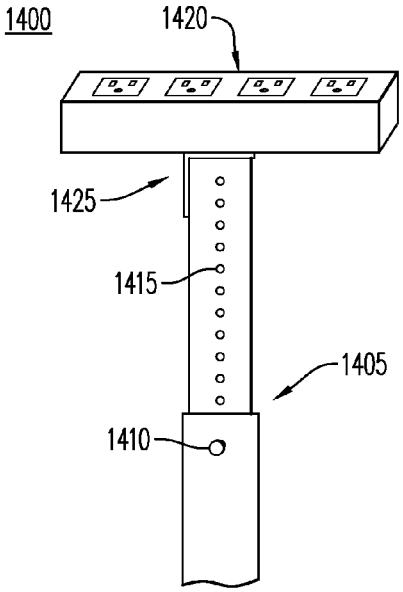
FIGS. 14-17 are illustrative depictions of another system, according to some embodiments.

FIGS. 14-17 demonstrate a multi-positional mounting system for a power strip in some embodiments of an electrical extension system herein. FIG. 14 depicts a system 1400 comprising, at least in part, an extension system 1405. Extension system 1405 includes a lower section 1410 and an upper section 1415. A power strip 1420 is coupled to a first end of upper section 1415. In some embodiments, the power strip 1420 may be removably coupled to the first end of upper section 1415. In the embodiments of FIGS. 14-17, a multi-positional mounting system 1425 for mounting the power strip to the first end of upper section 1415 is shown. In some aspects, the multi-positional mounting system 1425 may include a hinge, a ball joint, and other connectors having multiple axes of rotation.

Figure 15:
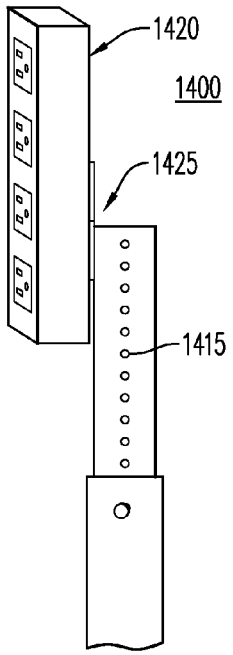
Figure 16:
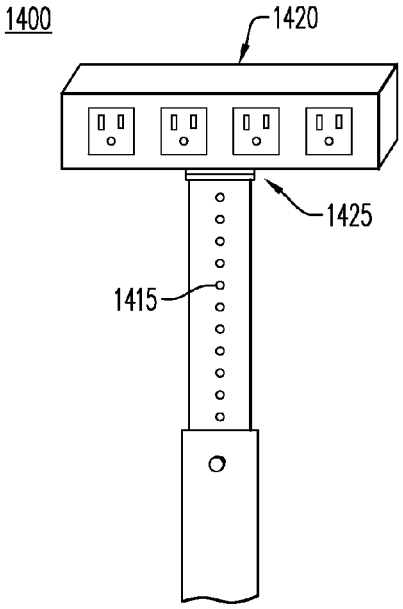
Figure 17:
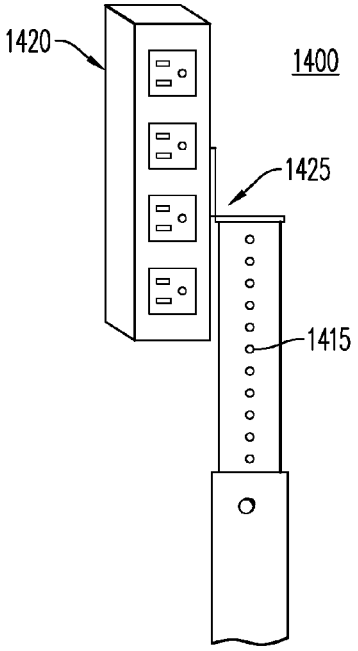

FIG. 14 shows the power strip 1420 with the outlets thereof positioned upwardly. FIG. 15 shows the power strip 1420 with the outlets thereof facing a left-looking orientation. FIG. 16 shows the power strip 1420 with the outlets thereof facing forward and FIG. 17 shows the power strip 1420 with the outlets thereof in a forward-facing position to the left of the upper section 1415. In some embodiments, the multi-positional mounting system 1425 in FIGS. 14-17 may be the same, alternate, or different from each other.

Figure 18:
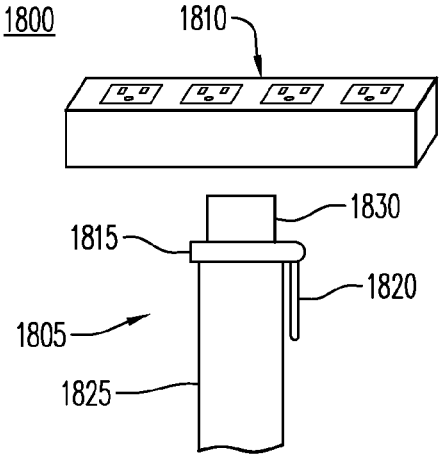
FIGS. 18-20 are illustrative depictions of yet another system, according to some embodiments.
Figure 19:
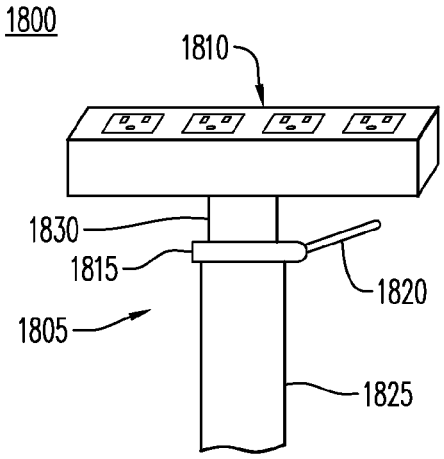
Figure 20:
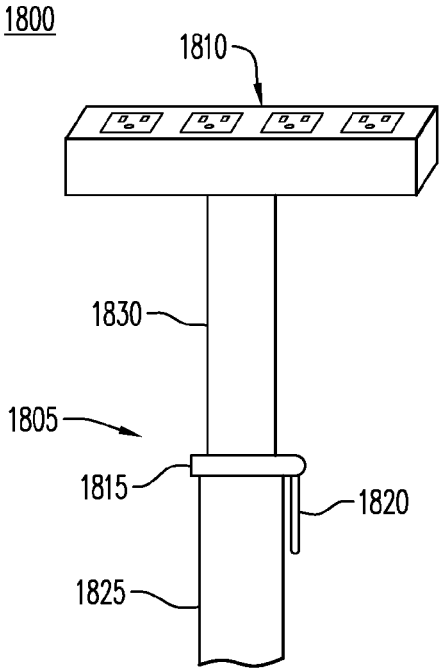

FIGS. 18-20 demonstrate an example of a selectively lockable mechanism for an electrical extension system 1800 herein, that may be manually manipulated to extend or retract an extension system. System 1800 includes an extension system 1805, as discussed hereinabove. System 1800 further includes a power strip 1810 disposed as shown, coupled to upper section 1830. System 1800 further includes a pressure-locking collar 1815 affixed to or otherwise coupled to an end of a lower section 1825 of the extension system 1805. Locking lever 1820 may be manipulated by a user to alternatively release and secure the pressure locking collar onto the upper section 1830.

FIG. 19 shows the extension system 1805 wherein the locking lever 1820 is in a "release" position. As such, locking collar 1815 releases the amount of pressure it applies to upper section 1830. Upper section 1830 may now be readily extended to a position as shown in FIG. 20. Once the upper section 1830 is in a desired position of extension, locking lever 1820 may be lowered to a "secure" position to lock the upper section 1830 in place via pressure applied thereto by locking collar 1815.

Figure 21:
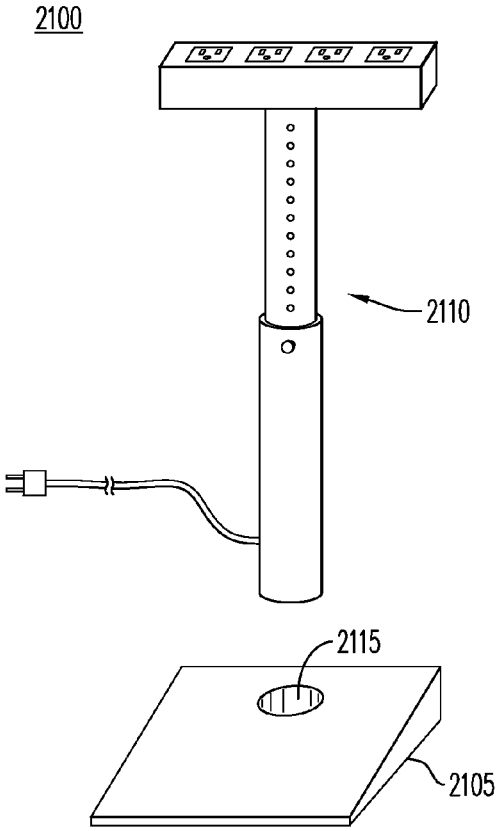
FIGS. 21-22 are illustrative depictions of yet another system, according to some embodiments.
Figure 22:
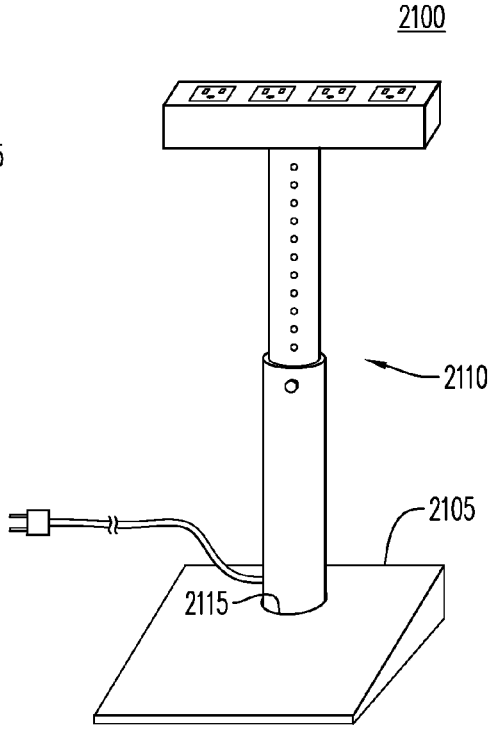

FIGS. 21 and 22 demonstrate an electrical extension system 2100 in accordance with some embodiments herein. System 2100 includes a base 2105 that is separate and discrete from an extension system 2110. In some aspects, this type of embodiment provides a system that may be efficiently shipped and stored, upgraded, and modified. In some instances, a base of a different style, weight, dimensions, color, etc. may be readily changed in the instance the base 2105 is separate and discrete from extension system 2110. As shown, base 2105 includes a receptacle or other mounting mechanism 2115 for matingly interfacing and coupling with the extension system 2110. FIG. 22 shows the extension system 2110 fully engaged with the base 2105 via receptacle or other mounting mechanism 2115. In some embodiments, it is see that a power cord may not be extended into or through the base 2100.

Figure 23:
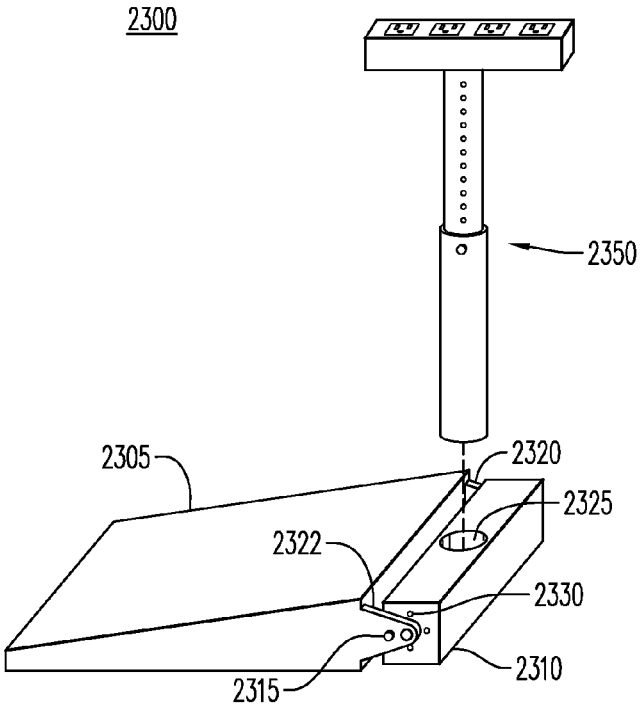
FIGS. 23 and 24 are illustrative depictions of some aspects of another system still, according to some embodiments.
Figure 24:
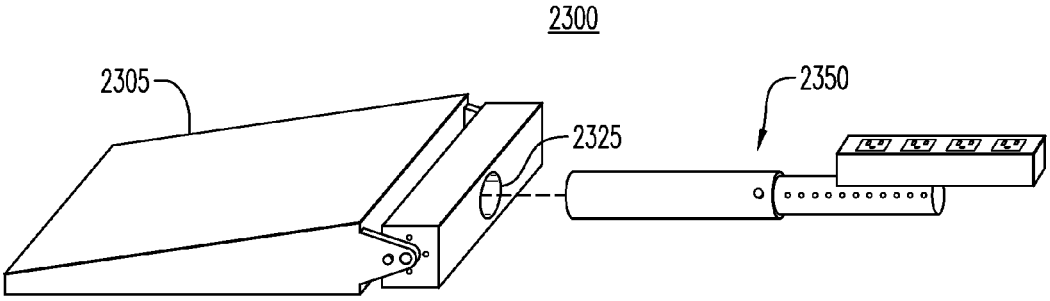

FIGS. 23 and 24 are illustrative depictions of another electrical extension system 2300 in accordance with some embodiments herein. FIG. 23 shows a system 2300 including a stationary base section 2305 and a movable or repositionable base section 2310. At least a portion of repositionable base section 2310 may move relative to the stationary base section 2305. In some aspects, a portion of repositionable base section 2310 moves (as opposed to repositionable base 2310 moving as a unit), such as a mounting receptacle 2325 for receiving and/or coupling extension system 2350 to the base of system 2300. In some embodiments, repositionable base 2310 may move as a whole, relative to stationary base section 2305.

In some aspects, extension system 2350 may be positioned in mounting receptacle 2325. As configured in FIG. 23, the extension system will be substantially vertical when mounted in the mounting receptacle 2325. In some instances, the mounting receptacle 2325 for receiving and/or coupling extension system 2350 to the base of system 2300 may be repositioned, alone or in cooperation with repositionable base 2310. In some instances, the mounting receptacle 2325 may be moved relative to stationary base section 2305 to a substantially horizontal position as illustrated in FIG. 24. In this configuration, extension system 2350 will be substantially horizontal to a surface on which the system is located.

Referring to FIG. 23, in some aspects repositionable base section 2310 moves by rotating on brackets 2322 and 2320. In some embodiments, a locking button or spring-loaded actuator 2315 and a corresponding receptacle 2330 may operationally cooperate to retain repositionable base section 2310 at one or more user-selectable positions. In some embodiments, more than two positions may be available for selectively positioning receptacle 2325.

These and other modifications may be made in the design and arrangement of other elements without departing from the scope of the invention as expressed in the appended claims.

Although the present invention has been described in connection with specific exemplary embodiments, it should be understood that various changes, substitutions, and alterations apparent to those skilled in the art can be made to the disclosed embodiments without departing from the spirit and scope of the invention as set forth in the appended claims.

What is claimed is:

1. An electrical extension system, comprising:

a signal cable extending to a signal outlet;

at least one device input port, the at least one device input port being in electrical communication with the signal cable;

an electrical strip, the electrical strip supporting the at least one device input port;

a telescoping extension, the telescoping extension having at least a lower section and an upper section and being manually extendable and contracted, the electrical strip being mounted on a first end of the upper section, and the signal cable extending through the telescoping extension to the signal outlet;

a power cable, the power cable being in electrical communication with the electrical strip;

a mechanism for maintaining the degree of extension and retraction of the movable extension section via at least one of a mechanical, tension, and frictional force; and a mechanism for disengaging the at least one of mechanical, tension, and frictional force to permit a selective adjustment of the degree of extension and retraction.

2. The electrical extension system of claim 1, further comprising:

a power receptacle mounted on the electrical strip, the power cable being electrically connected to the power receptacle and in electrical communication with a power outlet supported by the base.

3. The electrical extension system of claim 1, the electrical strip being manually repositionable to a plurality of discrete positions.

4. The electrical extension system of claim 1, wherein the at least lower section and upper section of the telescoping extension are repositionable to a plurality of predetermined, discrete positions.

5. The electrical extension system of claim 1, further comprising:

an electrical energy storage device housed within at least one of a base, the electrical strip, and the telescoping extension, the electrical energy storage device being in electrical communication with the electrical strip for providing a source of electrical energy at the electrical strip.

6. The electrical extension system of claim 1, wherein the telescoping extension is removably mounted on a base.

7. An electrical extension system, comprising:

a telescoping extension, the telescoping extension having at least a lower section and an upper section and being manually extendable and contracted;

a base to receive and support the telescoping extension, at least a portion of the base to receive the telescoping extension being repositionable in relation to a remaining portion of the base;

a power strip mounted on a first end of the upper section, the power strip being repositionable relative to the upper section of the telescoping extension;

a power cable, the power cable being in electrical communication with the power strip and extending through the telescoping extension and the base;

a mechanism for maintaining the degree of extension and retraction of the movable extension section via at least one of a mechanical, tension, and frictional force; and a mechanism for disengaging the at least one of mechanical, tension, and frictional force to permit a selective adjustment of the degree of extension and retraction.

8. The electrical extension system of claim 7, wherein the portion of the base to receive the telescoping extension is rotatable between the at least predetermined positions.

9. The electrical extension system of claim 7, further comprising:

an electrical energy storage device housed within at least one of the base, the electrical strip, and the telescoping extension, the electrical energy storage device being in electrical communication with the electrical strip for providing a source of electrical energy at the electrical strip.

10. The electrical extension system of claim 7, wherein the at least lower section and upper section of the telescoping extension are repositionable to a plurality of predetermined, discrete positions.

11. The electrical extension system of claim 7, wherein the telescoping extension is removably mounted on the base.

12. The electrical extension system of claim 7, further comprising a locking mechanism on the base to selectively lock the base in at least two predetermined positions.

13. The electrical extension system of claim 12, wherein the two predetermined positions orientate the portion of the base to receive the telescoping extension about ninety degrees offset from each other.

14. An electrical extension system, comprising:

a telescoping extension, the telescoping extension having at least a lower section and an upper section and being manually extendable and contracted;

a base to receive and support the telescoping extension, at least at two different locations on the base;

a power strip mountable on a first end of the upper section, the power strip being mountable to the first end of the upper section at least at one terminal end of the power strip and a non-terminal end of the power strip;

a power cable, the power cable being in electrical communication with the power strip and extending through the telescoping extension and the base;

a mechanism for maintaining the degree of extension and retraction of the movable extension section via at least one of a mechanical, tension, and frictional force; and a mechanism for disengaging the at least one of mechanical, tension, and frictional force to permit a selective adjustment of the degree of extension and retraction.

15. The electrical extension system of claim 14, wherein the power strip and the first end of the upper section electrically interface with each other using a plug and socket system.

16. The electrical extension system of claim 14, further comprising a support bracket to support the power strip.

17. The electrical extension system of claim 14, wherein the power strip is removably mountable to the first end of the upper section.

18. The electrical extension system of claim 14, further comprising:

an electrical energy storage device housed within at least one of the base, the electrical strip, and the telescoping extension, the electrical energy storage device being in electrical communication with the electrical strip for providing a source of electrical energy at the electrical strip.

* * * * *